US005462213A

United States Patent [19]

Watt

[11] Patent Number: 5,462,213

[45] Date of Patent: Oct. 31, 1995

[54] COMBINATION SEATS AND STORAGE CONTAINERS WITH CARRYING STRAPS

[76] Inventor: Robert W. Watt, 2703 Bockstruck La., Alton, Ill. 62002

[21] Appl. No.: 204,957

[22] Filed: Mar. 2, 1994

[51] Int. Cl.[6] ..... A45F 4/02

[52] U.S. Cl. ..... 224/155; 224/148; 224/209; 220/629; 248/188.2; 248/188.5; 62/457.1; 62/457.7; 312/351.3

[58] Field of Search ..... 224/148, 151, 224/153, 155, 209; 220/212, 324, 326, 343, 338, 441, 443, 629, 710; 297/129, 188.1; 206/315.11, 372, 373, 545; 108/43; 248/188.2, 188.5, 188.8, 411

[56] References Cited

U.S. PATENT DOCUMENTS

| | | | |
|---|---|---|---|
| 1,451,823 | 4/1923 | Hampton et al. | 62/457.1 |
| 3,229,942 | 1/1966 | Nalle | 312/351.3 |
| 3,916,639 | 11/1975 | Atkinson | 62/239 |
| 4,351,165 | 9/1982 | Gottsegen et al. | 62/457.7 |
| 4,574,594 | 3/1986 | Simmons et al. | 62/457.1 |
| 4,934,549 | 7/1990 | Allen | 220/629 |
| 5,329,787 | 7/1994 | Friday | 62/457.7 |
| 5,379,596 | 1/1995 | Grayson | 62/235.1 |

FOREIGN PATENT DOCUMENTS

| | | | |
|---|---|---|---|
| 1395737 | 3/1965 | France | 62/457.1 |

*Primary Examiner*—Henry L. Recla
*Assistant Examiner*—Gregory M. Vidovich

[57] ABSTRACT

A combination seat and storage container with carrying straps comprising a container which has trapezoidal shaped sidewalls and front and rear walls secured at their edges into a generally rectangular but downwardly tapering configuration. The container has a rectangular bottom wall secured at its periphery to the lower edges of the side, front and rear walls and a generally rectangular lid larger than the bottom wall pivotally secured along one edge to an upper edge of the rear wall and with a clasp securing the front edge of the lid to the front wall of the container. A pair of straps are secured to the rear wall for transportation purposes.

6 Claims, 4 Drawing Sheets

FIG 3
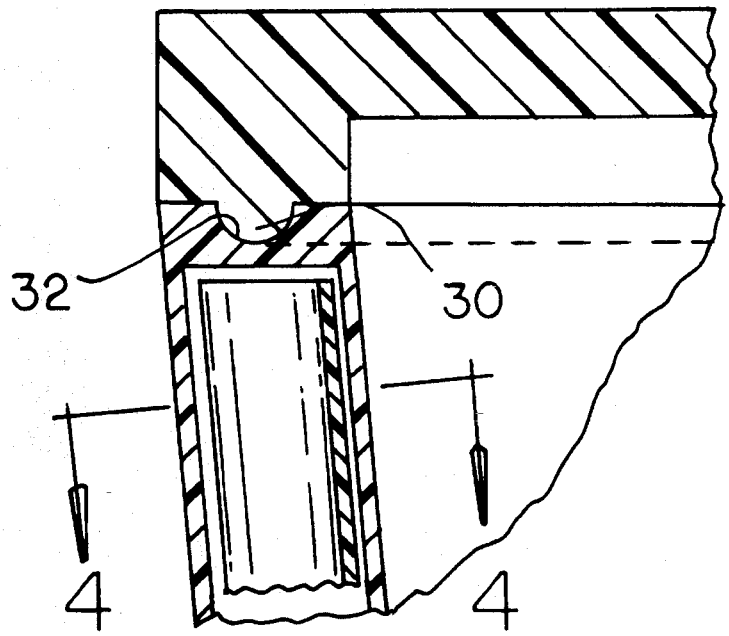
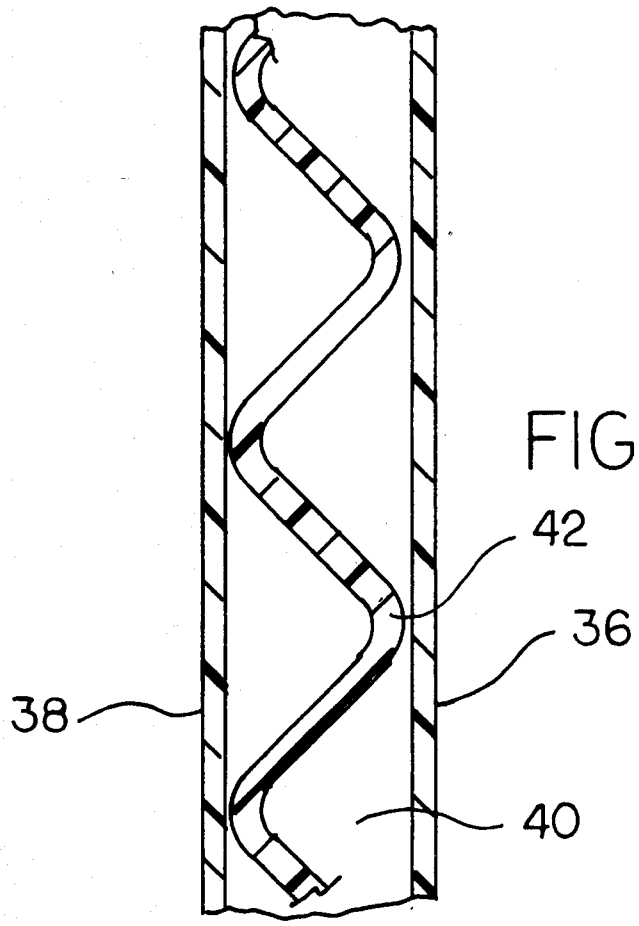
FIG 4

COMBINATION SEATS AND STORAGE CONTAINERS WITH CARRYING STRAPS

BACKGROUND OF THE INVENTION

1. Field of the Invention

The present invention relates to combination seats and storage containers with carrying straps and more particularly pertains to storing materials in a device with straps for transportation purposes and which also functions as a seat.

2. Description of the Prior Art

The use of storage containers and seats is known in the prior art. More specifically, storage containers and seats heretofore devised and utilized for the purpose of storing materials in a container and using the container as a seat are known to consist basically of familiar, expected, and obvious structural configurations, notwithstanding the myriad of designs encompassed by the crowded prior art which has been developed for the fulfillment of countless objectives and requirements.

By way of example, U.S. Pat. No. Des. 281,119 to Kalkus discloses a backpack cooler with molded back frame and seat.

U.S. Pat. No. Des. 295,580 to Thomas discloses a combined backpack and seat.

U.S. Pat. No. 4,795,068 to Blean discloses a backpack seat.

U.S. Pat. No. 5,016,792 to Jay discloses a backpack convertible chair.

Lastly, U.S. Pat. No. 5,186,372 to Biedenharn discloses a combination backpack and stool.

In this respect, the combination seats and storage containers with carrying straps according to the present invention substantially departs from the conventional concepts and designs of the prior art, and in doing so provides an apparatus primarily developed for the purpose of storing materials in a device with straps for transportation purposes and which also functions as a seat.

Therefore, it can be appreciated that there exists a continuing need for new and improved combination seats and storage containers with carrying straps which can be used for storing materials in a device with straps for transportation purposes and which also functions as a seat. In this regard, the present invention substantially fulfills this need.

SUMMARY OF THE INVENTION

In view of the foregoing disadvantages inherent in the known types of storage containers and seats now present in the prior art, the present invention provides an improved combination seats and storage containers with carrying straps. As such, the general purpose of the present invention, which will be described subsequently in greater detail, is to provide a new and improved combination seats and storage containers with carrying straps and method which has all the advantages of the prior art and none of the disadvantages.

To attain this, the present invention essentially comprises a new and improved combination seat and storage container with carrying straps comprising a container which has trapezoidal shaped side walls and front and rear trapezoidal shaped walls secured at their edges into a generally rectangular but downwardly tapering configuration. The container has a rectangular bottom wall secured at its periphery to the lower edges of the side, front and rear walls and a generally rectangular lid larger than the bottom wall pivotally secured along one edge to an upper edge of the rear wall and with a clasp securing the front edge of the lid to the front wall of the container. A pair of shoulder straps are secured to the rear wall for transportation purposes. The side, front and rear walls are fabricated of a double wall configuration with a honeycomb structure located therein for added beam strength. A padded seat is fixed to the upper surface of the lid for more comfortable seating by a user. There is a sealed projection on the lower surface of the lid around its periphery with a cooperable recess at the upper edge of the side, front and rear walls. Leveling legs are secured to the bottom wall adjacent its corners with associated pinch clamps to allow the extension or retraction of the legs. A liquid container for liquid is located within the container and a tube couples the bottom of the reservoir with the exterior of the device for drinking purposes.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide new and improved combination seats and storage containers with carrying straps which have all the advantages of the prior art storage containers and seats and none of the disadvantages.

It is another object of the present invention to provide new and improved combination seats and storage containers with carrying straps which may be easily and efficiently manufactured and marketed.

It is further object of the present invention to provide new and improved combination seats and storage containers with carrying straps which are of durable and reliable constructions.

An even further object of the present invention is to provide new and improved combination seats and storage containers with carrying straps which are susceptible of a low cost of manufacture with regard to both materials and labor, and which accordingly are then susceptible of low prices of sale to the consuming public, thereby making such combination seats and storage containers with carrying straps economically available to the buying public.

Still yet another object of the present invention is to provide new and improved combination seats and storage containers with carrying straps which provide in the apparatuses and methods of the prior art some of the advantages thereof, while simultaneously overcoming some of the disadvantages normally associated therewith.

Still another object of the present invention is to storing materials in a device with straps for transportation purposes and which also functions as a seat.

Lastly, it is an object of the present invention to provide new and improved combination seat and storage containers with carrying straps comprising a container which has trapezoidal shaped sidewalls and front and rear walls secured at their edges into a generally rectangular but downwardly tapering configuration. The container has a rectangular bottom wall secured at its periphery to the lower edges of the side, front and rear walls and a generally rectangular lid larger than the bottom wall pivotally secured along one edge to an upper edge of the rear wall and with a clasp securing the front edge of the lid to the front wall of the container. A pair of straps are secured to the rear wall for transportation purposes.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is a cross sectional view taken along line 3—3 of FIG. 1.

FIG. 4 is a cross sectional view taken along line 4—4 of FIG. 3.

The same reference numerals refer to the same parts through the various Figures.

DESCRIPTION OF THE PREFERRED EMBODIMENT

Figure 1:
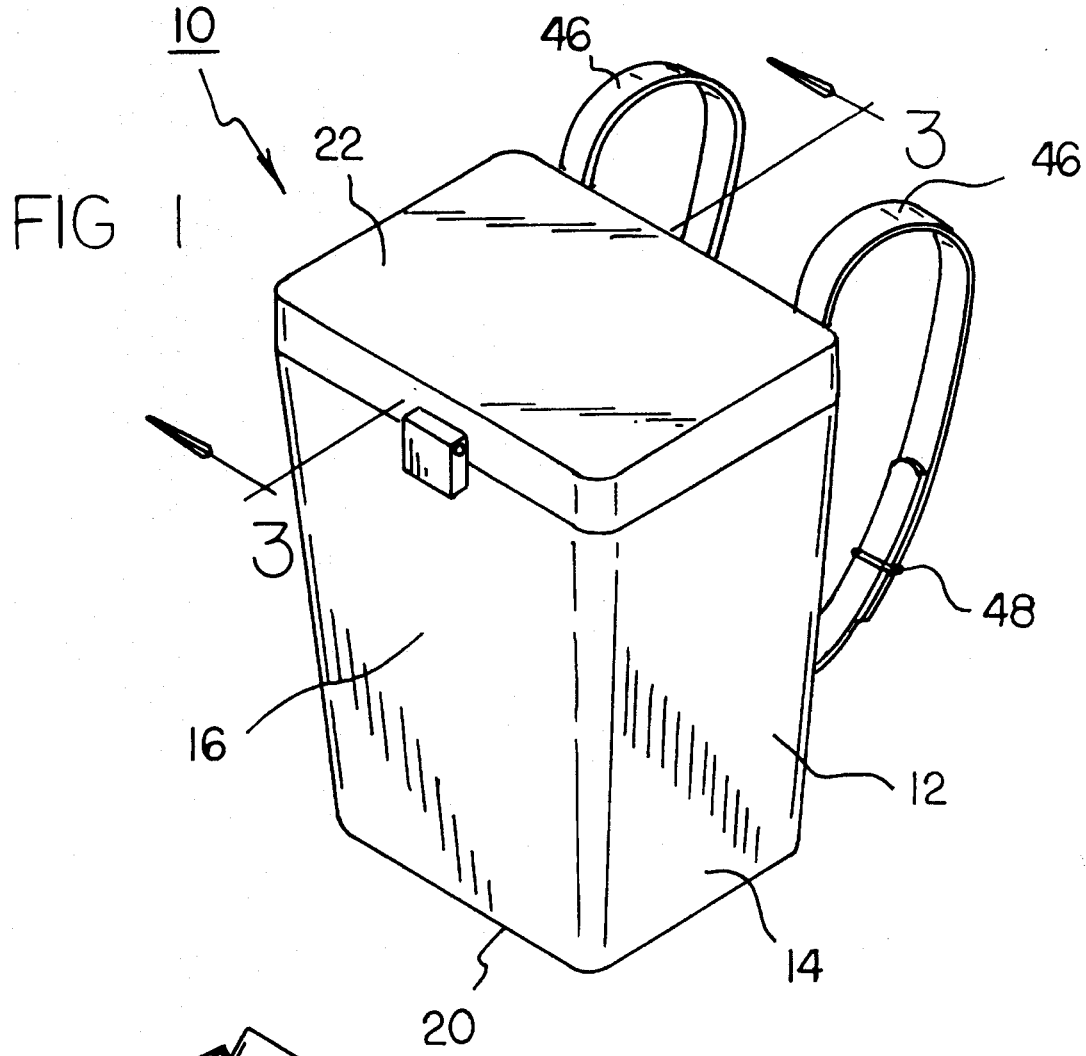
FIG. 1 is a perspective view of the preferred embodiment of the combination seats and storage containers with carrying straps constructed in accordance with the principles of the present invention.
Figure 2:
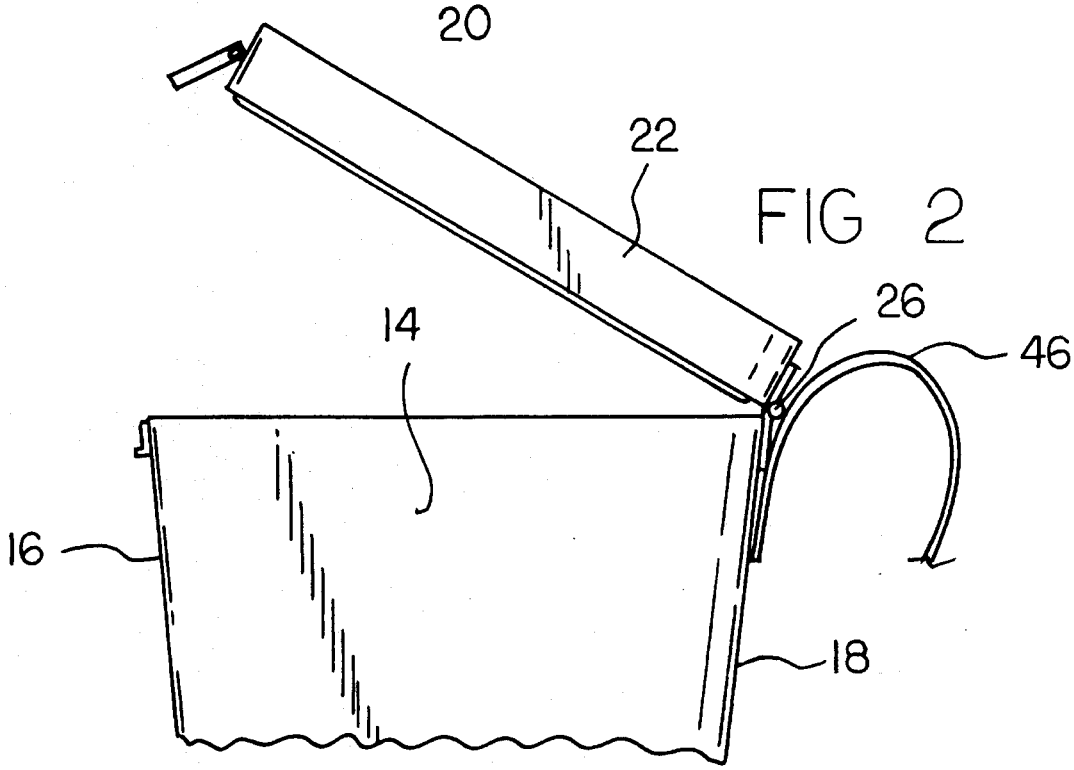
FIG. 2 is a side elevational view of the upper extent of the device of FIG. 1.
Figure 5:
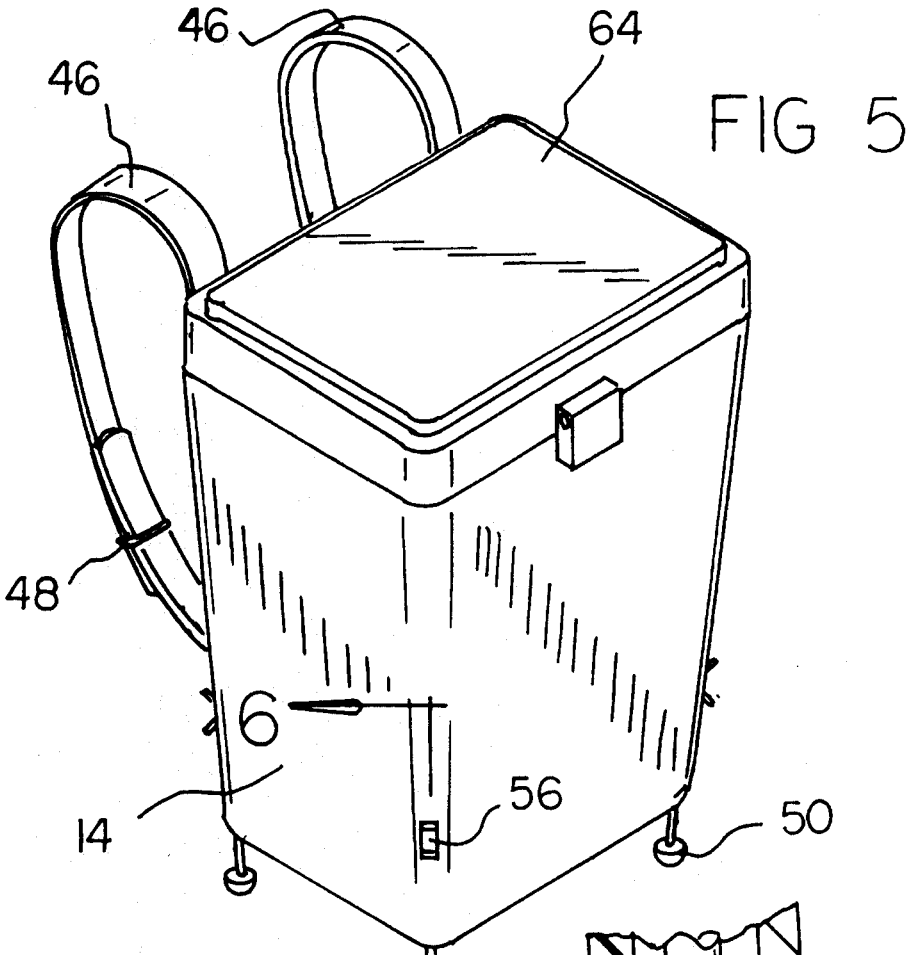
FIG. 5 is a perspective view of an alternate embodiment of the invention.
Figure 6:
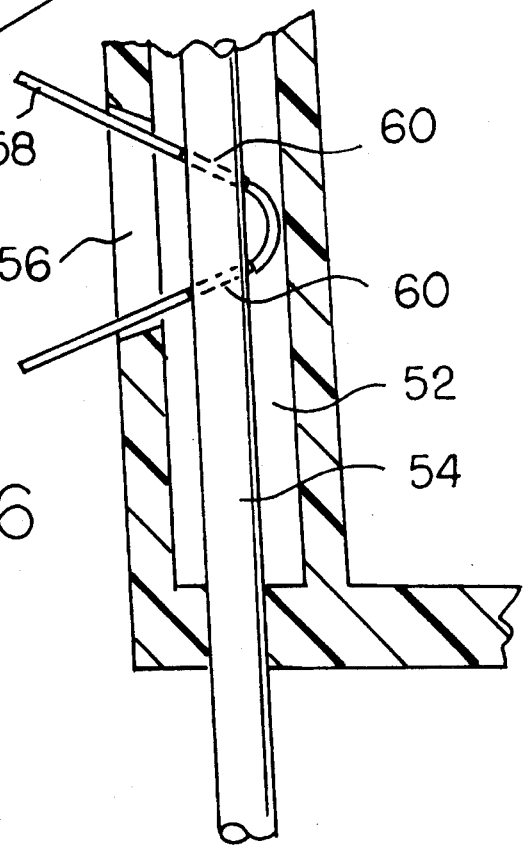
FIG. 6 is a cross sectional view taken along line 6—6 of FIG. 5.

With reference now to the drawings, and in particular to FIG. 1 thereof, the preferred embodiment of the new and improved combination seats and storage containers with carrying straps embodying the principles and concepts of the present invention and generally designated by the reference numeral 10 will be described.

Specifically, the combination seat and storage system 10 is made up of a container 12. The container has trapezoidal shaped side walls 14 and front and rear trapezoidal shaped walls 16 and 18. These walls are secured at their vertical edges into a generally rectangular cross sectional configuration. Such configuration, however, due to the trapezoidal shape of the walls, tapers downwardly from top to bottom.

The container 12 also has a rectangular bottom wall 20. The bottom wall is secured at its periphery to the lower edges of the side, front and rear walls. In addition, a generally rectangular lid 22 is also provided. The lid 22 is larger than the bottom wall 20 due to the tapering configuration of the walls of the container therebetween.

The lid is pivotally secured at one of its long edges, its rear edge, to the upper edge of the rear wall 18 through a hinge 26. The lid has downwardly extending flanges around its entire peripheral extent. A sealed projection 30 therearound is received in a similarly shaped recess 32 at the upper edge of the front, rear and side walls. The various walls and lid are fabricated of a elastomeric material such as polyethylene or polypropelene. Such helps to retain cold items in the container cold and hot things hot in the nature of a thermos bottle.

Shown in FIGS. 3 and 4 are greater details of the wall structure of the container 12. Specifically, the side, front and rear walls 14, 16, 18 and 20 are fabricated of a double wall configuration with an interior wall 36, and exterior wall 38 and a space therebetween. A semi-rigid material such as polyethylene or polypropelene is formed into an accordion like support structure 42 located within the space for added rigidity to the various walls. Added beam strength is thus then provided whereby added weight may be supported on the upper surface of the lid 22.

Secured to the rear wall 18 of the container are a pair of spaced shoulder straps 46. Such straps have an upper extent secured to the upper extent of the rear wall and a lower extent secured to the lower extent of the rear wall. Adjustment means 48 are provided to vary the length of the opening provided by the straps. In this manner, a wearer's arms may be passed through the two strap loops thereby created in order that the combination seat and storage system 10 may be carried on the back of a user.

Greater utility is provided to the system 10 through the use of leveling legs 50. One such leg is secured to the bottom wall adjacent to each corner. The legs extend upwardly into chambers 52 located in a vertical orientation at each corner of the container 12 between the spaces 40 along the flat sides of the various walls. The legs include rods 54 vertically moveable to any extent outwardly from the lower bottom wall 20 of the container. An opening 56 above the wall is provided above each lower corner. A spring clamp 58 extends through the opening and is provided with apertures 60 for the passage of the tube 54 therethrough. Upon holding the exposed ends 58 of the clamp together, each pipe may be raised or lowered at the discretion of the user to create the proper elevational location for the bottoms of the leveling legs for placing the container 12 so that its upper surface of the lid 22 is in a horizontal orientation. In this manner, the upper surface may be used as a seat for the user. The upper surface of the lid 22 is provided with a padded seat 64 for added comfort to the user. The peripheral edge of the cushion 64 is the same size or slightly smaller than the upper surface of the lid.

Figure 7:
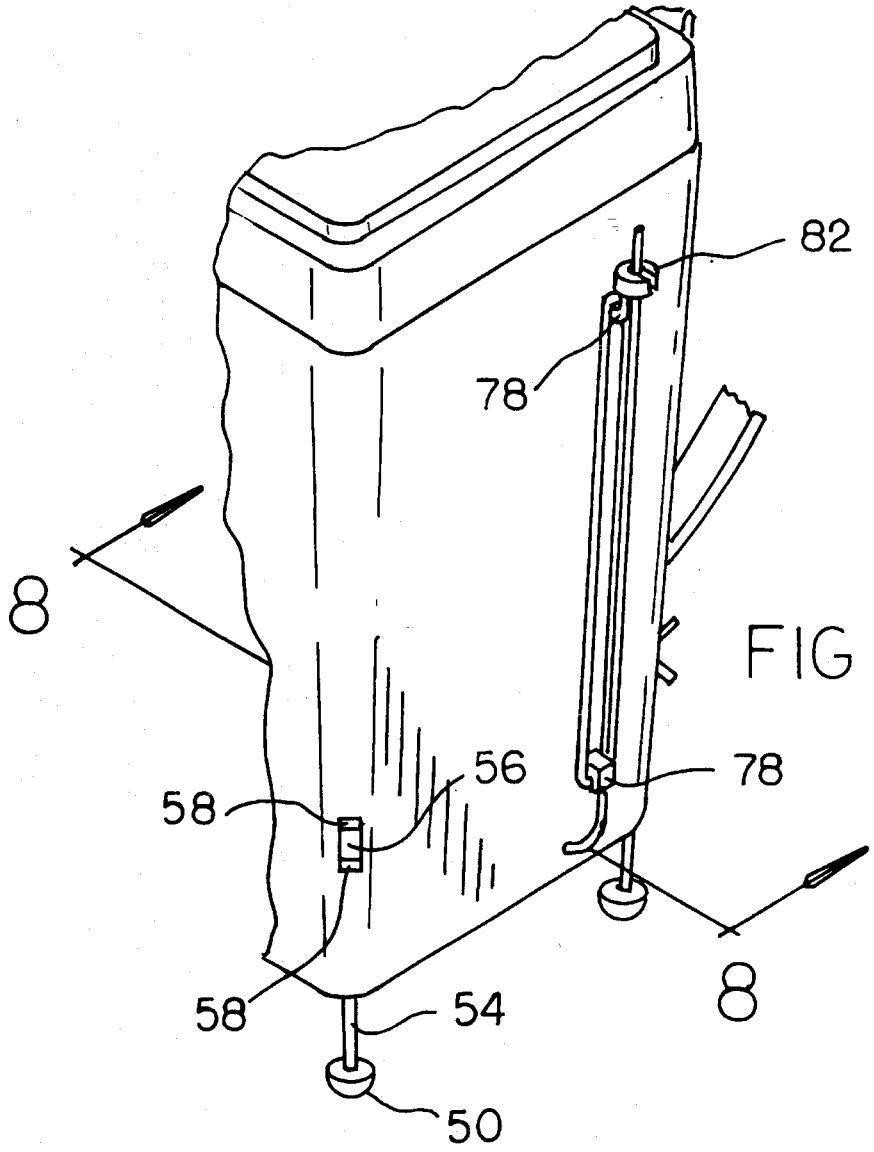
FIG. 7 is a perspective view of a portion of a container constructed with an other alternate embodiment of the invention.
Figure 8:
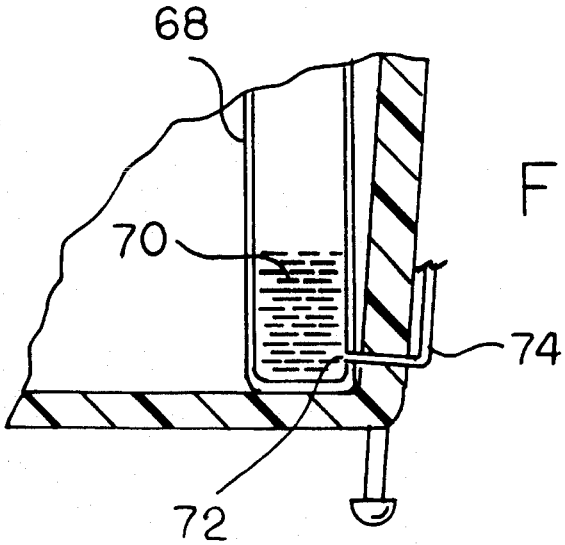
FIG. 8 is a cross sectional view taken along line 8—8 of FIG. 7.

The last feature of the invention is disclosed in the embodiment of FIGS. 7 and 8. In such embodiment, a container 68 is secured to the interior of the container 12 near one corner thereof. It extends in a vertical direction essentially the entire height of the container. The liquid container 68 is adapted to receive a liquid 70 as for example water. An aperture 72 is formed at the lower extent of the liquid container and a tube 74 extends from the container through the aperture upwardly for drinking purposes. The tube is shown as being a wrapped around fixed supports 78 about which it is wrapped. The upper extent or free end of the tube is held by a pinching clamp 82 to seal the end of the tube when not in use. Thus, when a drink of water or other liquid is desired, the free end of the tube is removed from the clamp 82 and unwrapped from its supports 78. Water may be sucked from the free end of the tube or, in the alternative, the container raised with regard to the lower end of the tube for letting water flow therefrom.

The present invention is a combination seat and storage container which can be used for any type of outdoor activity. It is broadly similar in shape to a relatively deep bucket, however, it is square at the top and tapered to a smaller square at its bottom. The sides are ribbed to create a honeycomb effect for strength. Two adjustable straps are affixed at either end with rivets near the top and bottom of one side and it can be carried like a backpack. An insulating bag is also provided and when this is inserted, the container serves as a cooler. Finally, a padded cover is hinge mounted at the top of the present invention and this serves as a comfortable seat when it is placed on the ground.

From the foregoing description, it can be seen that the present invention can be used to store all sorts of articles, including food and drink, and its tapered profile and lightweight construction make it very easy to carry. It is ideal for use by hunters, hikers, campers and anglers, and it can be carried to any outdoor sporting event. In the case of hunters and campers, the straps can be used for elevated overnight storage in a tree. Many outdoor enthusiasts improvise by using a five gallon bucket with a rope or strap for these purposes, however, this is bulky and unwieldy and difficult to carry.

The present invention is simply fabricated, lends itself readily to high volume production and can be inexpensively manufactured.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A new and improved combination seat and storage container with carrying straps comprising, in combination:

a storage container having trapezoidal shaped side walls and front and rear trapezoidal shaped walls forming a generally rectangular but downwardly tapering configuration, the storage container having a rectangular bottom wall having corners secured at its periphery thereof to lower edges of the side, front and rear walls and a generally rectangular lid larger than the bottom wall having a rear edge pivotally secured along an upper edge of the rear wall and with a clasp securing a front edge of the lid to the front wall of the container;

a pair of shoulder straps secured to the rear wall for transportation purposes;

the side, front and rear walls being fabricated of a double wall configuration with an accordion structure located therein for added strength;

a padded seat fixed to an upper surface of the lid for more comfortable seating by a user;

a sealed projection on a lower surface of the lid around its periphery thereof with a cooperable recess formed in the upper edge of the rear wall and an upper edge of the front and side walls;

each of said corners of said bottom wall having a substantially vertically extending bore, each of said bores extending within an associated wall of said walls of said storage container substantially along the length and intermediate said double wall configuration of the associated wall;

a plurality of leveling legs having a length substantially equivalent to said bores, each of said legs being mounted within one of said bores for extension therefrom or retraction therein, each of said legs having an associated pinch clamp to control the extension and retraction of said leg with respect to said bore; and a liquid container for liquid located within the storage container and a tube coupling the bottom of the liquid container with the exterior of the storage container for drinking purposes.

2. A combination seat and storage container comprising a storage container having trapezoidal shaped side, front and rear walls forming a generally rectangular but downwardly tapering configuration, the storage container having a rectangular bottom wall having corners secured at its periphery thereof to lower edges of the side, front and rear walls and a generally rectangular lid adapted to be sat on by a user and being larger than the bottom wall having a rear edge pivotally secured to an upper edge of the rear wall and with a clasp securing a front edge of the lid to the front wall of the container;

each of said corners of said bottom wall having a substantially vertically extending bore, each of said bores extending within an associated wall of said walls of said storage container substantially along the length thereof and intermediate front and rear surfaces of the associated wall;

a plurality of leveling legs having a length substantially equivalent to said bores, each of said legs being mounted within one of said bores for extension therefrom or retraction therein, each of said legs having an associated pinch clamp to control the extension and retraction of said leg with respect to said bore; and a pair of straps secured to the rear wall for transportation purposes.

3. The device as set forth in claim 2 wherein the front, rear and side walls are fabricated of a double wall configuration with an accordion structure located therein for added strength.

4. The device as set forth in claim 2 and further including:

a padded seat fixed to the upper surface of the lid for more comfortable seating by a user.

5. The device as set forth in claim 2 and further including:

a sealed projection on the lower surface of the lid around its periphery thereof with a cooperable recess formed in the upper edge of the rear wall and an upper edge of the front and side walls.

6. The device as set forth in claim 2 and further including:

a liquid container located within the storage container and a tube coupling the bottom of the liquid container with the exterior of the storage container for drinking purposes.

* * * * *